United States Patent [19]

Pierce

[11] 4,085,838

[45] Apr. 25, 1978

[54] TYPE CORRECTION ARTICLE EMPLOYING ADHESIVES

[75] Inventor: James N. Pierce, Stillwater, Minn.

[73] Assignee: Minnesota Mining and Manufacturing Company, Saint Paul, Minn.

[21] Appl. No.: 451,111

[22] Filed: Mar. 14, 1974

[51] Int. Cl.[2] ..... B41J 29/16

[52] U.S. Cl. ..... 197/181

[58] Field of Search ..... 197/151, 172, 181, 184, 197/185; 117/122 PA; 15/3.53, 104 R, 104 A, 424, 425, 210 R

[56] References Cited

U.S. PATENT DOCUMENTS 4,007,823 2/1977 Barouh et al. ..... 197/181

*Primary Examiner*—Clifford D. Crowder

*Attorney, Agent, or Firm*—Cruzan Alexander; Donald M. Sell; Warren R. Bovee

[57] ABSTRACT

An article adapted for the adhesive removal of typewritten, vertically cohesive ink characters from a substrate, said article comprising, in combination, a rigid body member having affixed thereto a resilient, discriminating adhesive portion in projecting relation to said body member, the adhesive portion of said article comprising a fused blend of a resin and a plasticizer and having a discriminating affinity for typewriter ink.

10 Claims, 5 Drawing Figures

TYPE CORRECTION ARTICLE EMPLOYING ADHESIVES

The present invention relates to methods and compositions useful in the field of correcting erroneous characters in typewritten material. More particularly, the present invention relates to a method of correcting typed characters by removal of the characters from the typewritten sheet so that new characters can be typed in the vacated areas. The invention also relates to adhesive compositions and correcting articles which are useful in the adhesive transfer of typed characters from a typewritten page to the correcting article.

From the inception of the use of writing or printing instruments, it has been necessary to devise means to correct errors in the written or printed material. The advent of the typewriter represented a great advance in the art of preparing printed materials and it is now possible to prepare neatly printed documents in a convenient manner not heretofore possible by other more cumbersome large scale printing methods. Concurrent with this ability to deposit neatly and precisely printed characters on paper with the stroke of a finger was the need to quickly, neatly, and clearly correct errors in typing. This problem has existed since the invention of the typewriter and has until now been solved only in a rather imperfect manner. It is of course most desirable that corrected typewritten documents be free of readily visible evidence of correction and that the correction process be quick and neat so as not to unduly delay the typing process or soil the operator's fingers or clothes or portions of the typewritten page.

In the past the correction of typewritten material has involved physically removing the typed character by scraping or abrading the ink, a method which often included the removal of the paper fibers beneath and surrounding the ink character. This method also had the disadvantage of generating particles of paper, ink, and erasing material which were free to fall into and adhere to the typewriter keys and other mechanism of the typewriter, causing smearing and maintenance problems.

Another approach has been to use cover-up compositions which blend with the color of the typewritten sheet, e.g. opaque white. These materials are applied, usually by painting or pressure transfer, to the character area and the character in effect "disappears" beneath them, leaving a white colored space on which a new character can be typed. This method of correction offers obvious disadvantages from a convenience and especially an appearance standpoint.

More recently an apparatus for type correction has been developed (See U.S. Pat. No. 3,724,633) whereby typewritten ink characters can be removed from a typewritten sheet, using a pressure-sensitive adhesive ribbon located on the typewriting machine. This system allows the operator to correct typing errors by back spacing to the desired point and pressing a special key which brings the pressure-sensitive adhesive ribbon into register with the desired character area. Then, by pressing the type key corresponding to the character to be removed, the pressure-sensitive ribbon is caused to contact the typing sheet in the character area, adhesively bond to the inked character and, on release of the type key, pull the inked character from the paper.

The above apparatus requires the use of a specially formulated typing ink which is adapted to have a greater internal cohesion than external adhesion to the substrate to which it is applied. Inks having this characteristic generally are deposited as a thin, integral, coherent film on the typing substrate. This allows a typed ink character to be contacted on its surface by an adhesive means and "plucked" from the surface of the paper as an integral unit, i.e. without fracturing internally and without leaving ink remaining on the paper. Inks having this property can be referred to as "vertically cohesive" inks. Correctable typewriter ribbons employing vertically cohesive inks are commercially available. One such product is available from International Business Machines, Inc. as "Correctable Film Ribbon", (reorder No. 1136432).

A superior type correcting method has now been developed which can be practiced by employing correcting articles comprising a unique, discriminating adhesive portion. The correcting articles of the present invention are used to contact and adhere to a vertically cohesive ink character which has been applied to a substrate and can thereafter effect removal of the character from the substrate by quick withdrawal of the article from contact with the substrate, as with a jerking or snapping motion, whereby the ink character is "plucked" from the substrate. The articles can comprise the discriminating adhesive composition alone in a convenient form which may inherently define a body member or handle or can comprise the adhesive in combination with associated supporting and/or applying means such as a sheet, stamp, key, handle, or other body member.

The correcting articles of the present invention provide a quick, neat and convenient method of removing erroneous typewritten characters. Unlike the prior art system which employs an aggressive, pressure-sensitive adhesive ribbon or tape, the present articles have no tendency to remove or tear paper fibers adjacent the ink character. The articles of the present invention also have the capability of easily making corrections after the typewritten sheet has been removed from the typewriter. The prior art apparatus noted previously (U.S. Pat. No. 3,724,633) requires precise indexing of the character to be corrected in order to place the erroneous character in exact register with the fixed adhesive carrier and to prevent mutilation of the paper adjacent the ink character by the pressure-sensitive adhesive tape. This precise indexing is extremely difficult once the sheet has been removed from the machine. In contrast, the articles and correcting method of the present invention can be utilized without such indexing. The only indexing necessary occurs when it is desired to retype a character in place of the one removed, which indexing need not be as precise as that for correcting by the prior art technique.

The invention can be more clearly understood with reference to the accompanying drawing wherein FIG. 1 is an elevational view showing a selected embodiment of a type correcting article.

Figure 1:
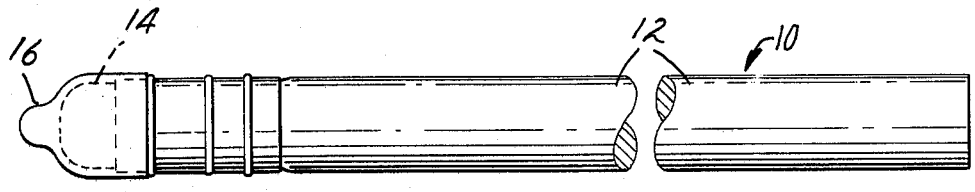
Figure 2:
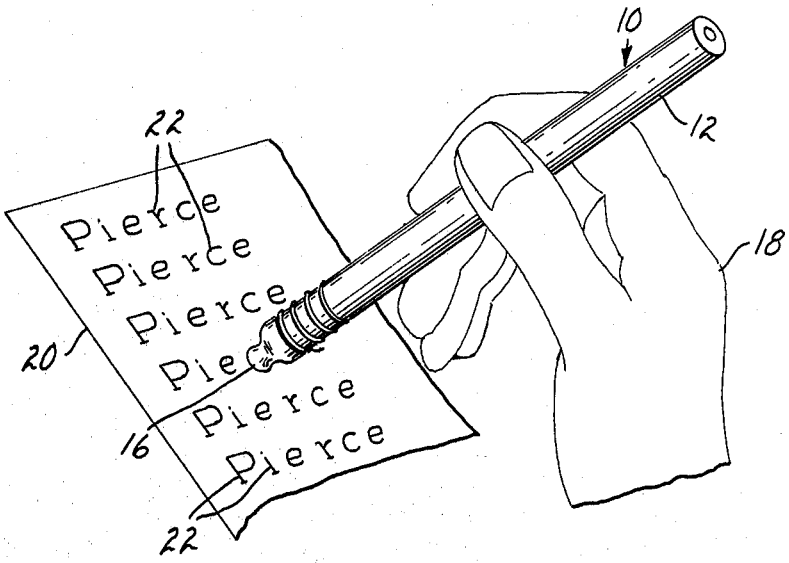
FIG. 2 shows the article illustrated in FIG. 1 being applied to an ink character typed on a sheet-like substrate.
Figure 3:
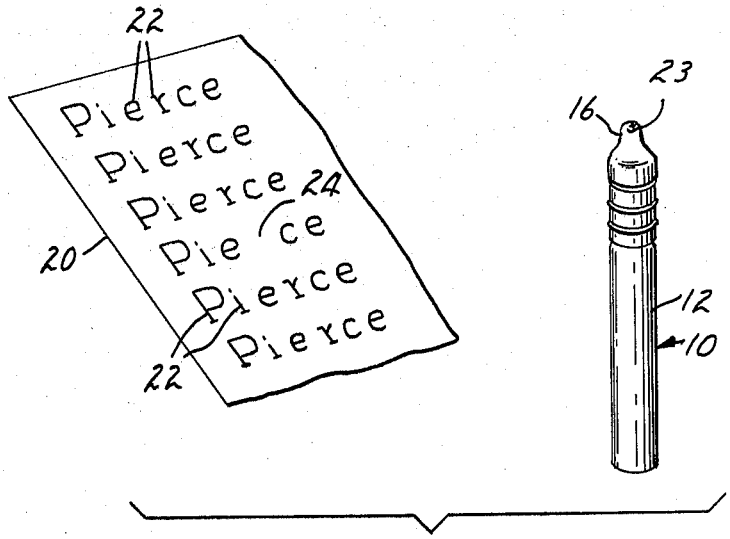
FIG. 3 shows the correcting article having an ink character adhering to the adhesive portion thereof after removal from the sheet-like substrate.

To more clearly illustrate the present invention, reference is made to the selected embodiment shown in FIGS. 1-3. FIG. 1 shows a correcting article 10 comprising a rigid shaft or rod 12 which serves as a handle or gripping means for the article, e.g. a wooden pencil, a deformable resilient base 14 on the end of shaft 12, e.g. the rubber eraser on the end of a pencil, and affixed to said base 14 a projecting, resilient discriminating adhesive portion 16 having the shape of a protuberant nipple. If desired, the resilient base 14 may be omitted and, by proper choice of shape and size for the projecting adhesive portion 16, the article 10 will function as an effective correcting article.

FIG. 2 illustrates the use of the article 10 shown in FIG. 1 to remove an erroneous, "vertically cohesive" ink character (not shown) from a sheet 20 wherein hand 18 holds article 10 by shaft 12 and hand 18 brings adhesive portion 16 of article 10 into contact with an erroneously typed character (not shown, but similar to the "vertically cohesive" typed characters 22) on sheet 20. Hand 18 then applies longitudinal force to shaft 12 whereby the resilient base 14 absorbs and distributes the longitudinal force applied by hand 18, and adhesive portion 16 deforms and intimately contacts and covers the surface of the erroneously typed character (not shown). Hand 18 then jerks article 10 away from sheet 20 and the erroneously typed character 23 thereby transfers from sheet 20 and remains adhered to adhesive portion 16 as shown in FIG. 3. A new character can then be typed in the space 24 vacated by erroneously typed character 23.

The correcting articles 10 of the present invention comprise at least one discriminating adhesive portion 16 defining a deformable, resilient projection, the surface of said projection having a discriminating affinity for typewriter ink, and a portion of said article 10 providing means 12 by which said article 10 can be gripped.

As used herein, the term "discriminating adhesive" refers to adhesives having a greater affinity for ink, i.e., a vertically cohesive ink, than for the substrate to which the ink is applied, e.g., paper. This property results from a combination of factors including the chemical and physical nature of the adhesives. Thus, it has been found that, in addition to having an adhesive affinity for ink, the adhesive must also be elastomeric and have greater internal cohesion than external adhesion to ink or paper. This combination of properties provides an adhesive which has a discriminating adhesive affinity for ink and which does not readily bond to the substrate surrounding the ink character, particularly a fibrous substrate such as paper. Moreover, after contacting the ink character, the adhesive can be quickly jerked away from the substrate and will "snap" or "pluck" the ink character from the substrate due to its elastomeric, snappy nature.

The desired balance of physical properties can be achieved by maintaining the tensile, elongation and flexibility or hardness within certain ranges. It has been found that a solid, flexible, adhesive material having a tensile and elongation at break of greater than 11 kg/cm$^2$ tensile and 200% elongation (measured on an "Instron" tensile tester at room temperature and at an elongation rate of about 12.5 cm per minute) is suitable. In addition, the Shore A hardness of a 1 cm thick slab of adhesive should be between about 20 and 60. Materials having physical properties bordering these ranges will be operative in the present invention as can be appreciated, but for a particularly preferred device these limits should be observed.

Figure 4:
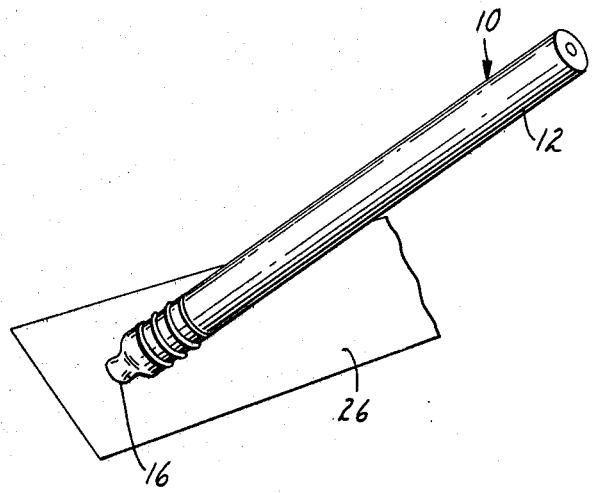
FIG. 4 shows the correcting article contacting a pressure-sensitive adhesive tape.
Figure 5:
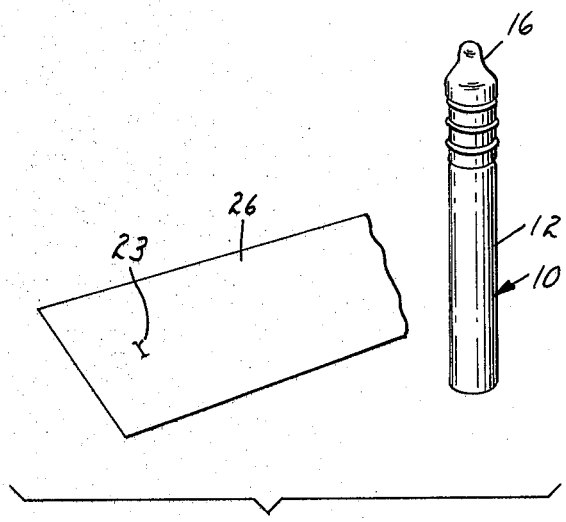
FIG. 5 shows the correcting article after withdrawal from the pressure-sensitive tape wherein the ink character is adhered to the tape.

The adhesive nature of the discriminating adhesives of the present invention is distinguishable from typical pressure-sensitive adhesive tapes, which are commonly defined as "aggressively and permanently tacky at room temperature and firmly adhere to a variety of dissimilar surfaces upon mere contact without the need of more than finger or hand pressure". "Test Methods for Pressure-Sensitive Tapes", 6th Edition, published by the Pressure-Sensitive Tape Council, Glenview, Illinois (1971), page 6. In contrast, the adhesives disclosed herein are discriminating in their adhesive affinity and are less aggressive than the known pressure-sensitive adhesives. This fact is readily illustrated by the ability of the discriminating adhesives to be cleaned on contact with known pressure-sensitive tapes (e.g. "Scotch Brand Magic Transparent Tape" No. 810, available commercially from 3M Co.), resulting in preferential transfer of ink residue from the discriminating adhesive to the pressure-sensitive tape. As shown in FIGS. 4 and 5, correcting article 10 having ink character 23 (not shown in FIG. 4) on adhesive portion 16 can be cleaned by bringing the character on adhesive portion 16 in contact with pressure-sensitive tape 26 and then withdrawing the adhesive portion 16 from contact with the pressure-sensitive tape 26. When the article 10 is withdrawn, character 23 preferentially adheres to the tape 26 leaving adhesive portion 16 clean. As noted previously, the discriminating adhesives of this invention have little tendency to aggressively bond to the paper or other substrate surrounding the ink character. In contrast, the adhesive ribbon used commercially in apparatus disclosed in U.S. Pat. No. 3,724,633 requires special means to prevent contact of the adhesive ribbon with the paper being typed due to the aggressive adhesive nature of the ribbon and the resulting tendency to tear the surrounding paper on removal.

Compositions which provide solid adhesives having the required discriminating properties can be obtained from blends of various classes of resins or polymers. A preferred group of discriminating adhesives comprises blends of polymeric resins and liquid plasticizers, such as a fused blend of a vinyl resin and a plasticizer therefor. The adhesive compositions can be further compounded with conventional additives which do not adversely affect the function of the adhesive such as fillers, extenders, colorants such as pigments and dyes, and heat and light stabilizers. The binder can comprise a single resin or can be formulated from mixtures of resins. Similarly, the plasticizer can be a single compound or a mixture of various plasticizers or types of plasticizers as will be more fully described hereinafter.

A particularly preferred adhesive blend according to the present invention comprises the plasticized resins commonly referred to as plastisols, i.e. resins fused with a liquid plasticizer. Preferred plastisols comprise vinyl containing resins such as polyvinyl chloride and vinyl chloride-vinyl acetate copolymers. These resins can be fused at elevated temperatures with liquid plasticizers so that a single phase, solid, thermoplastic discriminating adhesive is obtained. Plasticizers which may be used are the conventional liquid monomeric and polymeric plasticizers known in the art. Typical monomeric plasticizers are the phthalate, adipate and sebacate esters as well as the aryl phosphate esters. Typical polymeric plasticizers are the acetylated polyesters, such as the "Morflex" resins, and epoxy resins such as the "DER", "ERL" and "Epon" resins commercially available. Other plasticizers useful in the present invention are commercially available from Eastman Chemicals under the trademark "PA-3" and "PA-5" which plasticizers are particularly useful in combination with the poylvinyl chloride polymers and copolymers used herein. Plastisols useful as discriminating adhesives according to the present invention comprise blends of vinyl resins and various classes of plasticizers as shown in the following table.

Table I

| | % by Weight |
|---|---|
| 1. Polyvinyl Chloride - Vinyl Acetate (PVC 74, Diamond) | 30–55 |
| Plasticizer Adhesive (PA-5, Eastman Chemicals) | 45–70 |
| 2. Polyvinyl Chloride - Vinyl Acetate (PVC 74, Diamond) | 40 |
| Di-2 Ethyl Hexyl Phthalate (DOP - Several Suppliers) | 60 |
| 3. Polyvinyl Chloride - Vinyl Acetate (PVC 74, Diamond) | 40 |
| Epoxy Resin (DER-331 Dow Chemicals) | 60 |
| 4. Polyvinyl Chloride - Vinyl Acetate (PVC 74, Diamond) | 40 |
| Epoxy Resin (ERL-4221 Union Carbide) | 60 |
| 5. Polyvinyl Chloride - Vinyl Acetate (PVC 74, Diamond) | 40 |
| Acetylated Polyester (Morflex P-50A, Pfizer) | 60 |
| 6. Polyvinyl chloride - Vinyl Acetate (PVC 74, Diamond) | 40 |
| Acetylted Polyester (Morflex P-514, Pfizer) | 60 |
| 7. Polyvinyl Chloride - Vinyl Acetate (PVC 74, Diamond) | 40 |
| Polymeric Plasticizer (Plastolein 9774, Emery) | 60 |
| 8. Polyvinyl Chloride - Vinyl Acetate (VYNS, Union Carbide) | 36–40 |
| Plasticizer Adhesive (PA-5, Eastman Chemicals) | 60–64 |
| 9. Polyvinyl Chloride - Vinyl Acetate (VYHH, Union Carbide) | 50 |
| Plasticizer Adhesive (PA-5, Eastman Chemicals) | 50 |
| 10. Polyvinyl Chloride - Vinyl Acetate (Tenneco 1065, Tennessee Eastman) | 40 |
| Plasticizer Adhesive (PA-5, Eastman Chemicals) | 60 |
| 11. Polyvinyl Chloride (QYNV, Union Carbide) | 40 |
| Plasticizer Adhesive (PA-5, Eastman Chemicals) | 60 |

When formulating the plastisol blends shown above, adhesion to ink can be improved by the addition of minor amounts of mixtures of dimer acids and solid polyamide resins blended in a weight ratio of about 2:1 dimer acid to polyamide resin. The mixture is preferably added in amounts up to about 15 percent by weight of the total adhesive composition. The preferred dimer acids are aliphatic, dibasic acids produced by the polymerization of unsaturated fatty acids such as the dimer acids commercially available from Emery Industries, Inc. under the trademark "Empol". The polyamide resins preferred for use in the present invention can be derived from the reaction of dimer acids with diamines. Useful polyamide resins are commercially available from Emery Industries, Inc. under the trademark "Emerez", such as "Emerez" 1533 and 1540, and from General Mills under the trademark "Versamid" such as "Versamid" 940. The dimer acids and polyamide resins are melted, if solid, mixed with the vinyl resin and plasticizer, and heated to fuse the mixture as disclosed in greater detail hereinafter.

Other plasticized resin systems which provide the discriminating adhesives of the present invention comprise the polyvinyl acetal resins available commercially under the trademark "Butvar", for example polyvinyl butyral ("Butvar" 76, Shawinigan Resins Corp.). The polyester-polyurethane resins, such as the "Estane" resins commercially available from B. F. Goodrich, and styrene-butadiene block copolymers such as the "Kraton" polymers available commercially from Shell Chemical Corporation can also be used. Other polyurethane resins are also suitable for use in the present invention. When combined with a liquid plasticizer, as by fusion or solvation, these resins provide the discriminating adhesives having the balance of physical properties found useful in the present invention. In addition, the ethylenevinyl acetate resins are useful as discriminating adhesives. These resins are commercially available under the trademark "Elvax", and certain of these resins, for example, "Elvax" 40 (DuPont), need not be combined with plasticizers to be effective.

The adhesive compositions are prepared by the fusion of resins and liquid plasticizers. The preparation of a preferred adhesive composition can be conveniently carried out by blending a vinyl resin and a liquid plasticizer and optionally a mixture of a dimer acid and polyamide resin. The blend is then poured into a mold of the desired shape and the blend heated to the fusion point. On cooling, the composition becomes a flexible, resiliently deformable, solid adhesive. The flexibility depends on the type of resin and plasticizer used and the relative amounts of each. The adhesion of the composition to typewriter ink is also dependent on the type and relative amounts of resin, plasticizer and the optional mixture of dimer acid and polyamide resin as well as the physical surface characteristics of the solid composition. It has been found that best results are obtained with a solid composition having a very smooth surface since the operation of the discriminating adhesive is facilitated by intimate contact with the ink. The smooth surface can be readily obtained by employing a mold for forming and cooling the composition which has a very smooth inside surface such as a smooth glass or polished metal surface such as an aluminum surface. Formation of the solid composition in free air by allowing a drop of the fused liquid composition to cool and solidify on the end of a suspended rod will also provide a smooth surface.

As can be appreciated, the form or shape of the projecting, adhesive portion 16 of the correcting articles 10 of this invention does not affect the basic chemical or physical properties of the adhesive composition. However, the shape of the projecting adhesive portion 16 can enhance the correcting function of the article 10 by providing for more intimate contact between the projecting, adhesive portion 16 of the article 10 and a typewritten character, which character 22,23 is often partially indented in the paper surface. It has been found that a projecting adhesive portion 16 resembling a nipple-like protuberance at the end of an elongated supporting means performs quite well, although other projecting shapes, such as a frustum, have also been found useful. The projecting, adhesive portion 16 preferably has a surface area approximating the area covered by a typed character 22,23. Thus, when the adhesive contacts the typed character 23 to be removed, slight hand pressure will cause the projection to spread over the substrate 20 which carries the character 23 and intimately contact the complete surface of the typed character 23. If the projection is initially too large or deforms too extensively, it will spread excessively under pressure and contact characters 22 adjacent the character 23 to be removed. Thus, a balance must be maintained between the flexibility, size, and shape of the projecting, adhesive portion 16 of the article 10 in order to facilitate the precise and neat removal of individual typewritten characters.

As noted previously, the correcting articles 10 of the present invention include means by which the projecting adhesive portion 16 is gripped, held or supported, so that the projecting adhesive portion 16 can be conveniently made to contact typed ink characters to be corrected. The means by which the articles 10 can be gripped can include any means which allows the projecting adhesive portion 16 of the article 10 to be brought into contact with a typewritten character 23 on a sheet 20 whether said sheet is in or out of the typewriter. It is preferred that the means be a rigid body member such as an elongated shaft 12 so that the adhesive portion 16 can conveniently be caused to contact areas remote from the user's hand 18 which may otherwise be difficult to reach. The body member can be a distinct member associated with the projecting adhesive portion 16 of the article or can be formed from the adhesive itself. Thus in one embodiment the correcting article consists solely of the discriminating adhesive. For example, a tapered rod formed entirely of the solid, discriminating adhesive composition can be used as a correcting article without the aid of a separate gripping or supporting member. However, construction of such an article is uneconomical since a large amount of the adhesive composition is used for each article and the use of a distinct body member, such as a plastic or wooden shaft 12 or handle, is more economical and is a preferred embodiment of the present invention. The articles 10 of the present invention are particularly useful in the form of an elongated rod shaft 12 having a projecting, adhesive end portion 16. Other means will suggest themselves to the skilled worker, depending on the particular application for which the article 10 is intended.

A suitable correcting article 10 can be prepared according to the present invention by blending the adhesive components described above such as a polyvinyl chloride resin and a liquid plasticizer. The adhesive components are placed in a smooth surfaced mold of the desired shape, heated to fusion and subsequently cooled to provide a solid element which is or contains a projecting adhesive portion 16 such as a protuberant nipple-like portion. This element can then be used alone or attached to a body member or handle such as an elongated rod, pencil 12 or the like, by an adhesive or other fastening means.

Alternatively, a body member such as a glass, plastic, or wooden rod or the eraser end of a pencil 12 can be dipped into a liquid resin-plasticizer composition and removed, whereby a quantity of the liquid composition forms a deposit on the end of the body member. The member is then hung vertically in an oven at elevated temperature causing the composition to fuse and form a nipple-like protuberance on the end of the body member.

The correcting articles 10 of the present invention are particularly suited for the correction of typewritten characters 22,23. In practicing this aspect of the invention, the typist first inserts a correctable ribbon into the typewriter and types the characters on the substrate 20 which preferably is a paper sheet. When it is desired to correct one or more of the characters 22,23, the typist merely contacts the erroneously typed character 23 with the adhesive portion 16 of the correcting article 10 and applies slight hand pressure to cause the adhesive to deform, substantially cover and intimately contact or "wet" the surface of the character 23. After a brief period (1 or 2 seconds) the typist quickly jerks the article 10 away from the substrate 20, e.g. with a quick "snapping" motion. Due to the snappy, elastomeric, discriminating nature of the adhesives of this invention, the typed character 23 adheres to the adhesive portion 16 of the correcting article 10 and is pulled away from the substrate 20 without damage to the surrounding substrate. The typist then adjusts the substrate 20, if necessary, and types the new character in the space vacated by the erroneous character 23. The character removal can be performed with the typewritten substrate in or out of the typewriter.

After use, the correcting article 10 may have a significant quantity of ink adhered to it which may affect its adhesive qualities adversely. The article 10 may be conveniently cleaned by contacting, such as by pressing or rolling, the adhesive portion 16 with a piece of a pressure-sensitive adhesive tape, such as the previously mentioned "Scotch Brand Magic Transparent Tape" No. 810. Since the pressure-sensitive tapes are more aggressively adhesive than the adhesive portion 16 of the correcting article 10, the ink transfers from the article 10 to the tape and the article 10 is effectively cleaned and readied for further use.

The practice of the present invention can be illustrated by reference to the following representative examples.

EXAMPLE 1

A type correcting article was prepared by providing 40 grams of a powdered vinyl chloride — vinyl acetate resin (PVC 74, Diamond Chemicals Co.) and homogeneously blending this resin with 60 grams of a plasticizer (PA-5, Eastman Chemicals). The homogeneous mixture was then poured into a mold which was in the form of a long tapered glass tube about 11.5 cm in length (standard centrifuge tube) and heated to 125° - 130° C. for about 10 minutes. At this temperature the resin melted and fused with the plasticizer to form a solid plastisol. This fused composition was cooled to room temperature and removed from the mold. The elongated solid article was used to remove characters which had been typed onto paper with a correctable ribbon having a vertically cohesive ink, by pressing the tapered end of the article onto the freshly typed character, maintaining contact with the character briefly (about 1 second), and quickly jerking the article from the paper as with a quick "snapping" action. In some cases it was necessary to repeat this step to completely remove the ink. The article was cleaned or "regenerated" after use by contacting the ink adhering to the article with a piece of pressure-sensitive adhesive tape ("Scotch Brand Magic Transparent Tape" No. 810), whereby the ink adhered to the tapered end of the article was transferred to the tape.

EXAMPLE 2

A type correction article was prepared by providing a homogeneous blend of resin and plasticizer as in Example 1, and pouring the liquid blend into a container. A conventional wooden pencil having a rounded rubber eraser attached to one end was dipped in the liquid composition to coat the eraser portion of the pencil. When the pencil was removed, some of the viscous liquid adhered to the pencil. The pencil was hung vertically (eraser end down) in an oven and heated at 125° - 130° C. to fuse the resin and plasticizer in the form of a solid, flexible, nipple-like protuberance on the end of the eraser. After cooling, the article was used to remove characters which had been typed with a correctable ribbon as in Example 1. The configuration of the adhesive portion of the correcting stick was found to be particularly suitable for correcting typed letters. The nipple-like shape was deformed sufficiently to cover a single typed character without disturbing adjacent characters, thus allowing selective correction of typed characters.

EXAMPLE 3

A type correction article was prepared as in Example 2 except that a glass rod 20 cm. long and 0.5 cm. in diameter was used in place of the eraser tipped pencil of Example 2. This device was found suitable for correcting typed characters as in the previous examples.

EXAMPLE 4

A discriminating adhesive was prepared by combining a first mixture of 34 parts/wt. vinyl resin (PVC 74, Diamond Chemicals)
54 parts/wt. plasticizer (PA-5, Eastman Chemicals).

A second mixture comprising the following was prepared:

8 parts/wt. dimer acid ("Empol" 1022, Emery Industries),
4 parts/wt. polyamide resin ("Emerez" 1533, Emery Industries).

This second mixture was heated to 150° C. to form a homogeneous liquid and blended, with mixing, into the first mixture.

A type correcting article was then prepared by pouring the adhesive blend into a polished aluminum mold and heating 14 minutes at 150° C. to fuse. The protuberant molded adhesive composition was attached to a pencil end and worked well as a type correcting article.

EXAMPLE 5

A type correcting article was prepared by melting an ethylene-vinyl acetate resin ("Elvax" 40, DuPont) in an oven at 150° C., and the rounded eraser end of a wooden pencil was dipped into the melt and suspended in the oven (150° C.) long enough for the resin to develop a smooth protuberant shape. The pencil was then removed from the oven and cooled. The article was useful as a type correcting stick when used as described in Example 1.

EXAMPLE 6

A type correcting article was prepared by melting a polyester-urethane resin ("Estane" 58110, B. F. Goodrich) and blending 20% by weight plasticizer (PA-5) therewith. The rounded eraser end of a wooden pencil was dipped into the blend, removed, and the adhering resin cooled to form a protuberant adhesive tip. The article was useful as a type correcting stick when used as described in Example 1.

EXAMPLE 7

A type correcting article was prepared by dissolving a 50:50 blend of a styrene-butadiene block copolymer ("Kraton" 1108, Shell Chemicals) and a plasticizer (PA-5) in methyl ethyl ketone to provide a 20% solids solution. The rounded eraser end of a wooden pencil was dipped into the solution, removed, and the adhering adhesive material allowed to air dry. When dry, the material formed an adhesive film on the pencil eraser. The article was useful as a type correcting stick when used as described in Example 1.

I claim:

1. An article having particular utility in the corrective removal of typewritten ink characters from typing substrates such as paper, said characters being of the type characterized by greater internal cohesion than external adhesion to said substrates, said article comprising (a) at least one discriminating adhesive portion comprising a fused blend of 30 to 55 parts by weight vinyl resin and 70 to 45 parts by weight compatible plasticizer, said portion defining a deformable resilient projection, the surface of said projection having a discriminating affinity for typewriter ink, and (b) means by which said article can be gripped.

2. An article according to claim 1 wherein said discriminating adhesive portion is a plastisol consisting essentially of a fused blend of 30 to 55 parts by weight compatible vinyl resin and 70 to 45 parts by weight plasticizer.

3. An article according to claim 1 wherein said vinyl resin is selected from the group consisting of polyvinyl chloride, polyvinyl chloride-acetate, and polyvinyl acetal.

4. An article according to claim 1 wherein said plasticizer is a liquid monomeric plasticizer selected from the group consisting of organic acid esters and aryl phosphate esters.

5. An article according to claim 1 wherein said plasticizer is a liquid polymeric plasticizer.

6. An article according to claim 5 wherein said liquid polymeric plasticizer is selected from the group consisting of epoxy resins and acetylated polyester resins.

7. An article according to claim 1 wherein said blend additionally contains up to 15% by weight of the total composition of a mixture comprising dimer acid and solid polyamide resin.

8. An article having particular utility in the corrective removal of typewritten ink characters from a paper substrate, said characters being of the type characterized by greater internal cohesion than external adhesion to paper, said article comprising (a) at least one discriminating adhesive portion defining a deformable resilient projection, the surface of said projection having a discriminating affinity for typewriter ink, said discriminating adhesive portion comprising a plastisol consisting essentially of 30 to 55 parts by weight vinyl resin, 70 to 45 parts by weight plasticizer and additionally up to 15 percent by weight, based on the total composition, of a mixture of dimer acid and solid polyamide resin, and (b) means by which said article can be gripped.

9. A discriminating adhesive composition useful in manufacturing an article having particular utility in the corrective removal of typewritten ink characters from typing substrates such as paper, said characters being of the type characterized by greater internal cohesion than external adhesion to said substrates, said article comprising (a) at least one discriminating adhesive portion defining a deformable resilient projection, the surface of said projection having a discriminating affinity for typewriter ink, and (b) means by which said article can be gripped, said composition comprising a fused blend of vinyl resin, a compatible plasticizer for said vinyl resin and an adhesion improving amount, up to about 15 percent by weight of the total composition, of a blend of dimer acid and solid polyamide resin and including means for attaching said composition to said means by which said article can be gripped.

10. A method of removing an individual typewritten ink character from a substrate, said ink character being of the type characterized by greater internal cohesion than external adhesion to the substrate, the method comprising (a) contacting an area including said ink character with a deformable, resilient, discriminating adhesive having a discriminating affinity for said ink character, said discriminating adhesive comprising a fused blend of 30 to 55 parts by weight vinyl resin and 70 to 45 parts by weight compatible plasticizer, (b) applying sufficient force to said discriminating adhesive to cause said discriminating adhesive to deform and substantially cover said character area, (c) maintaining said force for a time sufficient to allow said discriminating adhesive to intimately contact the surface of said ink character, (d) quickly jerking said discriminating adhesive from the surface of said substrate whereby said ink character adheres to said discriminating adhesive and is removed from said substrate, and (e) contacting said ink character adhered to said discriminating adhesive with a pressure-sensitive adhesive, whereby said ink character is transferred from the discriminating adhesive to said pressure-sensitive adhesive.

* * * * *